US009188897B2

(12) United States Patent
Takeuchi

(10) Patent No.: US 9,188,897 B2
(45) Date of Patent: Nov. 17, 2015

(54) TRANSFER DEVICE, IMAGE FORMING APPARATUS, AND POWER SUPPLY CONTROL METHOD

(71) Applicant: Tomokazu Takeuchi, Kanagawa (JP)

(72) Inventor: Tomokazu Takeuchi, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/028,891

(22) Filed: Sep. 17, 2013

(65) Prior Publication Data

US 2014/0079421 A1 Mar. 20, 2014

(30) Foreign Application Priority Data

Sep. 18, 2012 (JP) ..... 2012-205093
Sep. 12, 2013 (JP) ..... 2013-189459

(51) Int. Cl.
*G03G 15/00* (2006.01)
*G03G 13/16* (2006.01)
*G03G 15/16* (2006.01)

(52) U.S. Cl.
CPC ..... *G03G 13/16* (2013.01); *G03G 15/1605* (2013.01); *G03G 15/1675* (2013.01); *G03G 2215/00738* (2013.01)

(58) Field of Classification Search
USPC ..... 399/66, 314
See application file for complete search history.

(56) References Cited

U.S. PATENT DOCUMENTS

2008/0260401 A1 10/2008 Shimazaki
2011/0229168 A1 9/2011 Shiraishi et al.
2012/0045231 A1 2/2012 Ogino et al.
2012/0045237 A1 2/2012 Aoki et al.
2012/0045259 A1 2/2012 Nakamura et al.
2012/0213536 A1 8/2012 Takeuchi
2012/0230715 A1 9/2012 Ogino et al.
2012/0237234 A1 9/2012 Sugimoto et al.
2012/0237271 A1 9/2012 Sengoku et al.
2012/0243892 A1 9/2012 Nakamura et al.
2012/0308250 A1 12/2012 Shimizu et al.
2012/0315058 A1 12/2012 Shimizu et al.
2012/0321336 A1 12/2012 Ogiyama
2012/0328314 A1 12/2012 Sugimoto et al.

(Continued)

FOREIGN PATENT DOCUMENTS

JP 2008-058585 3/2008
JP 2012-042835 3/2012

(Continued)

*Primary Examiner* — Walter L Lindsay, Jr.
*Assistant Examiner* — Ruth Labombard
(74) *Attorney, Agent, or Firm* — Oblon, McClelland, Maier & Neustadt, L.L.P.

(57) ABSTRACT

A transfer device includes a power supply control unit, a direct-current (DC) power supply, an alternating-current (AC) power supply, and a transfer unit. The power supply control unit controls a first control signal for controlling a DC voltage and a second control signal for controlling an AC voltage based on a condition relating to image formation. The DC power supply outputs the DC voltage based on the first control signal. The AC power supply selectively outputs, with a particular waveform, either of the DC voltage output from the DC power supply or a superimposed voltage obtained by superimposing the AC voltage determined based on the second control signal on the DC voltage output from the DC power supply. The transfer unit transfers a developer onto a sheet using a voltage output from the AC power supply.

19 Claims, 13 Drawing Sheets

(56) References Cited

U.S. PATENT DOCUMENTS

| | | | |
|---|---|---|---|
| 2012/0328315 | A1 | 12/2012 | Takeuchi et al. |
| 2012/0328320 | A1 | 12/2012 | Fujita et al. |
| 2012/0328321 | A1 | 12/2012 | Takeuchi et al. |
| 2013/0004190 | A1 | 1/2013 | Sengoku et al. |
| 2013/0011155 | A1 | 1/2013 | Ogiyama et al. |
| 2013/0016989 | A1 | 1/2013 | Fujita et al. |
| 2013/0064559 | A1 | 3/2013 | Nakamura et al. |
| 2013/0078014 | A1 | 3/2013 | Ogiyama |
| 2013/0089363 | A1 | 4/2013 | Mimbu et al. |
| 2013/0094870 | A1 | 4/2013 | Shimizu et al. |
| 2013/0121714 | A1 | 5/2013 | Tanaka et al. |
| 2013/0136468 | A1 | 5/2013 | Shimizu et al. |
| 2013/0136477 | A1 | 5/2013 | Ogiyama et al. |
| 2013/0142531 | A1 | 6/2013 | Sugimoto et al. |
| 2013/0148993 | A1 | 6/2013 | Aoki et al. |
| 2013/0164011 | A1 | 6/2013 | Nakamura et al. |
| 2013/0177329 | A1 | 7/2013 | Tanaka et al. |
| 2013/0195483 | A1 | 8/2013 | Shimizu et al. |
| 2013/0216281 | A1 | 8/2013 | Suzuki et al. |

FOREIGN PATENT DOCUMENTS

| | | |
|---|---|---|
| JP | 2013-127592 | 6/2013 |
| JP | 2013-171141 | 9/2013 |
| WO | 2012/128373 | 9/2012 |

FIG.7A

| PRINT SPEED MODE | DC (-) OUTPUT VALUE |
|---|---|
| LOW SPEED | OUTPUT VALUE×0.8 |
| MEDIUM SPEED | OUTPUT VALUE×1.0 |
| HIGH SPEED | OUTPUT VALUE×1.2 |

FIG.7B

| SHEET THICKNESS | DC (-) OUTPUT VALUE |
|---|---|
| 1 | OUTPUT VALUE×0.7 |
| 2 | OUTPUT VALUE×0.8 |
| 3 | OUTPUT VALUE×0.9 |
| 4 | OUTPUT VALUE×1.0 |
| 5 | OUTPUT VALUE×1.1 |
| 6 | OUTPUT VALUE×1.2 |
| 7 | OUTPUT VALUE×1.3 |

FIG.7C

| ENVIRONMENT | DC (-) OUTPUT VALUE |
|---|---|
| LOW-TEMPERATURE AND LOW-HUMIDITY | OUTPUT VALUE×0.9 |
| LOW-TEMPERATURE AND HIGH-HUMIDITY | OUTPUT VALUE×1.0 |
| NORMAL | OUTPUT VALUE×1.0 |
| HIGH-TEMPERATURE AND LOW-HUMIDITY | OUTPUT VALUE×1.0 |
| HIGH-TEMPERATURE AND HIGH-HUMIDITY | OUTPUT VALUE×1.1 |

FIG.7D

| DC (-) OUTPUT VALUE | DC_PWM DUTY RATIO |
|---|---|
| 0.0 μA | 0% |
| -20.0 μA | 20% |
| -40.0 μA | 40% |
| -60.0 μA | 60% |
| -80.0 μA | 80% |
| -100.0 μA | 100% |

FIG.8A

| PRINT SPEED MODE | AC_CLK FREQUENCY SET VALUE |
|---|---|
| LOW SPEED | 500 Hz |
| MEDIUM SPEED | 700 Hz |
| HIGH SPEED | 900 Hz |

FIG.8B

| SHEET THICKNESS | AC (-) OUTPUT VALUE |
|---|---|
| 1 | OUTPUT VALUE×0.7 |
| 2 | OUTPUT VALUE×0.8 |
| 3 | OUTPUT VALUE×0.9 |
| 4 | OUTPUT VALUE×1.0 |
| 5 | OUTPUT VALUE×1.1 |
| 6 | OUTPUT VALUE×1.2 |
| 7 | OUTPUT VALUE×1.3 |

FIG.8C

| ENVIRONMENT | AC (-) OUTPUT VALUE |
|---|---|
| LOW-TEMPERATURE AND LOW-HUMIDITY | OUTPUT VALUE×0.9 |
| LOW-TEMPERATURE AND HIGH-HUMIDITY | OUTPUT VALUE×1.0 |
| NORMAL | OUTPUT VALUE×1.0 |
| HIGH-TEMPERATURE AND LOW-HUMIDITY | OUTPUT VALUE×1.0 |
| HIGH-TEMPERATURE AND HIGH-HUMIDITY | OUTPUT VALUE×1.1 |

FIG.8D

| UNEVENNESS | AC (-) OUTPUT VALUE |
|---|---|
| 1 | OUTPUT VALUE×1.0 |
| 2 | OUTPUT VALUE×1.5 |
| 3 | OUTPUT VALUE×2.0 |
| 4 | OUTPUT VALUE×2.5 |
| 5 | OUTPUT VALUE×3.0 |
| 6 | OUTPUT VALUE×3.5 |
| 7 | OUTPUT VALUE×4.0 |

FIG.8E

| AC (-) OUTPUT VALUE | AC_PWM DUTY RATIO |
|---|---|
| 0.0 kVpp | 0% |
| 2.0 kVpp | 20% |
| 4.0 kVpp | 40% |
| 6.0 kVpp | 60% |
| 8.0 kVpp | 80% |
| 10.0 kVpp | 100% |

FIG.11A

| EXAMPLE | PRINT SPEED MODE | SHEET THICKNESS | ENVIRONMENT | UN-EVENNESS | AC_CLK FREQUENCY SET VALUE | AC (-) OUTPUT VALUE | AC_PWM DUTY RATIO | DC (-) OUTPUT VALUE | DC (-) VOLTAGE: LOAD 100 MΩ |
|---|---|---|---|---|---|---|---|---|---|
| 1 | MEDIUM SPEED | 4 | NORMAL | 1 | 700 Hz | 2.00 kVpp | 20.0% | -80.0 μA | -8.00 kV |

FIG.11B

| EXAMPLE | PRINT SPEED MODE | SHEET THICKNESS | ENVIRONMENT | UN-EVENNESS | AC_CLK FREQUENCY SET VALUE | AC (-) OUTPUT VALUE | AC_PWM DUTY RATIO | DC (-) OUTPUT VALUE | DC (-) VOLTAGE: LOAD 100 MΩ |
|---|---|---|---|---|---|---|---|---|---|
| 2 | HIGH SPEED | 6 | HIGH-TEMPERATURE AND HIGH-HUMIDITY | 4 | 900 Hz | 6.60 kVpp | 66.0% | -126.7 μA | -6.91 kV |

FIG.11C

| EXAMPLE | PRINT SPEED MODE | SHEET THICKNESS | ENVIRONMENT | UN-EVENNESS | AC_CLK FREQUENCY SET VALUE | AC (-) OUTPUT VALUE | AC_PWM DUTY RATIO | DC (-) OUTPUT VALUE | DC (-) VOLTAGE: LOAD 100 MΩ |
|---|---|---|---|---|---|---|---|---|---|
| 3 | LOW SPEED | 2 | LOW-TEMPERATURE AND LOW-HUMIDITY | 7 | 500 Hz | 5.76 kVpp | 57.6% | -46.1 μA | -4.61 kV |

TRANSFER DEVICE, IMAGE FORMING APPARATUS, AND POWER SUPPLY CONTROL METHOD

CROSS-REFERENCE TO RELATED APPLICATIONS

The present application claims priority to and incorporates by reference the entire contents of Japanese Patent Application No. 2012-205093 filed in Japan on Sep. 18, 2012 and Japanese Patent Application No. 2013-189459 filed in Japan on Sep. 12, 2013.

BACKGROUND OF THE INVENTION

1. Field of the Invention

The present invention relates to a transfer device, an image forming apparatus, and a power supply control method.

2. Description of the Related Art

Typically, electrophotography image forming apparatuses apply a direct-current (DC) voltage to an electrostatic toner pattern formed on an image carrier, thereby moving a developer, such as a toner, forming the electrostatic toner pattern to a sheet. Thus, electrophotography image forming apparatuses transfer the electrostatic toner pattern onto the sheet.

In use of a sheet having a highly uneven surface and low surface smoothness, such as leather-like paper and Japanese paper, a developer is less likely to be transferred onto recessed portions compared with protruding portions. This renders printing on the recessed portions unclear.

To address this, Japanese Laid-open Patent Publication No. 2008-058585, for example, discloses a technology for increasing the transfer ratio of a developer onto recessed portions by superimposing an alternating-current (AC) voltage on a DC voltage for transfer to generate a sinusoidal wave and causing the developer to oscillate.

In the conventional technology, a toner reciprocates between a toner carrier and a sheet with the AC frequency. This increases the transferability at the recessed portions on the sheet surface. However, the developer scatters due to the oscillation of the toner, thereby generating a blur on an image. In the conventional technology, even if the voltage is output by superimposing the AC component for oscillation of the toner on the DC component for transfer, the superimposition makes the peak voltage in a transfer-direction polarity extremely high depending on conditions for image formation. This facilitates aerial discharge, thereby generating a void at the protruding portions on the sheet surface. To address this, it is necessary to develop a technology for increasing the transfer ratio of the developer onto the recessed portions on the sheet surface and forming a high-quality image.

Therefore, there is a need for a transfer device, an image forming apparatus, and a power supply control method that are capable of increasing the transfer ratio of a developer onto recessed portions on a sheet surface and improving the image quality regardless of conditions for image formation.

SUMMARY OF THE INVENTION

According to an embodiment, there is provided a transfer device that includes a power supply control unit, a direct-current (DC) power supply, an alternating-current (AC) power supply, and a transfer unit. The power supply control unit controls a first control signal for controlling a DC voltage and a second control signal for controlling an AC voltage based on a condition relating to image formation. The DC power supply outputs the DC voltage based on the first control signal. The AC power supply selectively outputs, with a particular waveform, either of the DC voltage output from the DC power supply or a superimposed voltage obtained by superimposing the AC voltage determined based on the second control signal on the DC voltage output from the DC power supply. The transfer unit transfers a developer onto a sheet using a voltage output from the AC power supply.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 7A to 7D are views of examples of setting for a DC_PWM signal according to the embodiment;

FIGS. 8A to 8E are views of examples of setting for an AC_PWM signal and an AC_CLK signal according to the embodiment;

FIGS. 11A to 11C are views of examples of a frequency set value of an AC_CLK signal, an AC(−) output value, a duty ratio of the AC_PWM signal, and a DC(−) output value determined depending on print settings according to the embodiment;

DETAILED DESCRIPTION OF THE PREFERRED EMBODIMENTS

Exemplary embodiments of a transfer device, an image forming apparatus, and a power supply control method according to the present invention are described below in greater detail with reference to the accompanying drawings.

While the image forming apparatus according to the present invention is applied to an electrophotography monochrome copier in the embodiments below, for example, it is not necessarily applied thereto. The image forming apparatus according to the present invention is applicable to any type of apparatus, whether monochrome or color, as long as the apparatus forms an image by electrophotography. The image forming apparatus is applicable to an electrophotography printer and multifunction peripheral (MFP), for example. An MFP is an apparatus having at least two functions among a printing function, a copying function, a scanning function, and a facsimile function.

A configuration of a copying system according to an embodiment of the present invention will now be described.

Figure 1:
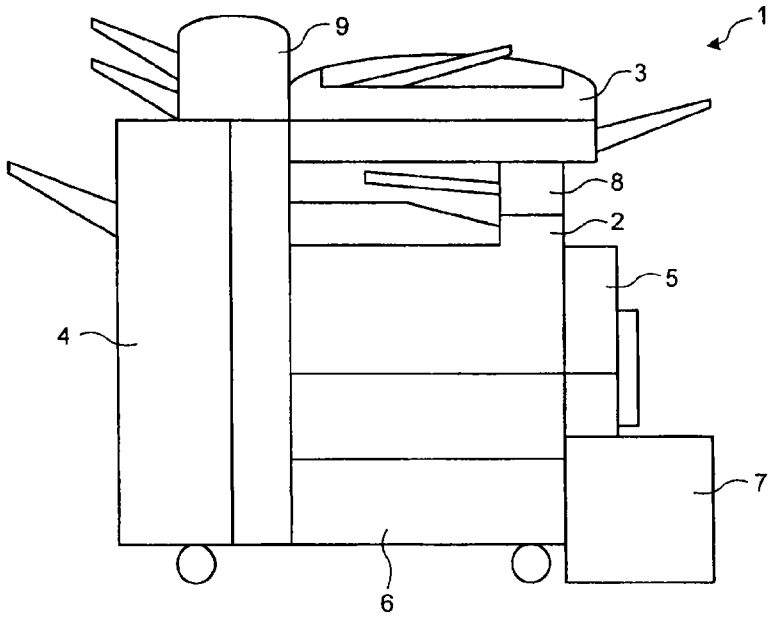
FIG. 1 is a schematic of an example of an entire configuration of a copying system according to an embodiment of the present invention.

FIG. 1 is a schematic of an example of an entire configuration of a copying system 1 according to the present embodiment. As illustrated in FIG. 1, the copying system 1 includes a copier 2, an automatic document feeder (ADF) 3, a finisher 4, a duplex reverse unit 5, an expanded paper feed tray 6, a large-volume paper feed tray 7, an insert feeder 8, and a 1-bin discharge tray 9.

The copier 2 corresponds to a main body of the copying system 1. The copier 2 includes a scanner unit, an image forming unit, a paper feeding unit, and a transfer unit (the scanner unit and the paper feeding unit are not illustrated, and the image forming unit and the transfer unit are not illustrated in FIG. 1). The scanner unit electrically reads a document, thereby generating image data. The image forming unit forms an image based on the image data generated by the scanner unit. The paper feeding unit feeds a sheet. The transfer unit transfers the image thus formed onto the sheet. In the description below, a sheet onto which an image is transferred may be referred to as a copy.

The ADF 3 automatically feeds a document to the copier 2 (specifically, to the scanner unit of the copier 2).

The finisher 4 is what is called a post-processing device including a stapler and a shift tray and performs post-processing, such as stapling, on a copy made by the copier 2. The post-processing performed by the finisher 4 is not limited thereto, and the finisher 4 may perform post-processing, such as stapling, punching (perforation), and folding.

The duplex reverse unit 5 reverses a sheet onto which an image is transferred on one side and returns the sheet to the copier 2 (specifically, the transfer unit of the copier 2) to carry out duplex copying on the sheet.

The expanded paper feed tray 6 is a paper feed tray for expansion and feeds a sheet to the transfer unit of the copier 2.

The large-volume paper feed tray 7 can accommodate a larger number of sheets than the paper feeding unit of the copier 2 and the expanded paper feed tray 6. The large-volume paper feed tray 7 feeds a sheet to the transfer unit of the copier 2.

The insert feeder 8 feeds a sheet, such as a cover sheet and a slip sheet, to the transfer unit of the copier 2.

The 1-bin discharge tray 9 includes a bin to which a sheet is discharged, and a copy made by the copier 2 is discharged thereto.

Figure 2:
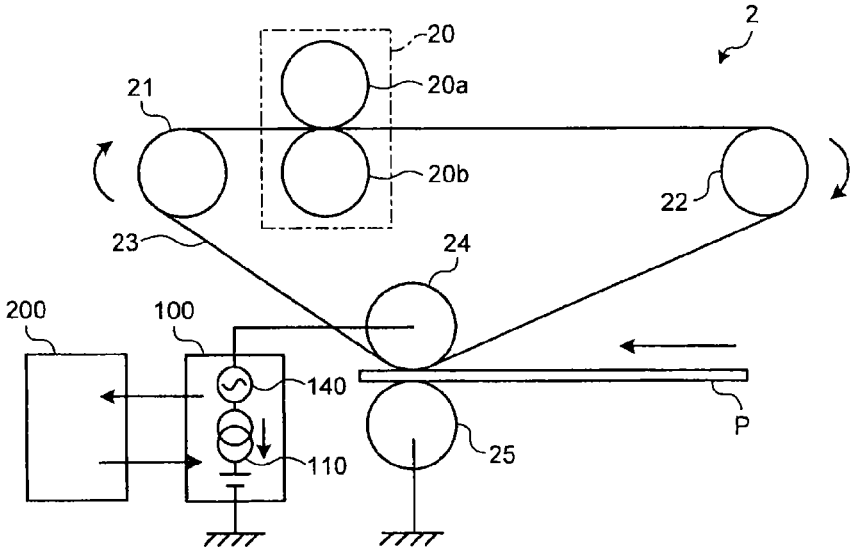
FIG. 2 is a schematic of an example of a configuration relating to image formation and transfer of a copier according to the embodiment.

FIG. 2 is a schematic of an example of a configuration relating to image formation and transfer of the copier 2 according to the present embodiment. As illustrated in FIG. 2, the copier 2 includes an image forming unit 20, driving rollers 21 and 22, an intermediate transfer belt 23, a repulsive roller 24, a secondary transfer roller 25, a secondary transfer power supply 100, and a power supply control unit 200.

The image forming unit 20 includes a photosensitive drum 20*a*, a charging device, a developing device, a primary transfer roller 20*b*, and a cleaning device (the charging device, the developing device, and the cleaning device are not illustrated).

The image forming unit 20 and an irradiation device, which is not illustrated, performs an image forming process (a charging process, an irradiation process, a developing process, a transfer process, and a cleaning process) on the photosensitive drum 20*a*. Thus, the image forming unit 20 and the irradiation device form an electrostatic toner pattern on the photosensitive drum 20*a* and transfer the electrostatic toner pattern onto the intermediate transfer belt 23.

In the charging process, the charging device, which is not illustrated, charges the surface of the photosensitive drum 20*a* that is driven to rotate.

In the irradiation process, the irradiation device, which is not illustrated, irradiates the charged surface of the photosensitive drum 20*a* with optically modulated laser light. Thus, the irradiation device forms an electrostatic latent image on the surface of the photosensitive drum 20*a*.

In the developing process, the developing device, which is not illustrated, develops the electrostatic latent image formed on the photosensitive drum 20*a* with a toner (an example of a developer). This processing forms an electrostatic toner pattern, which is a toner image obtained by developing the electrostatic latent image with the toner, on the photosensitive drum 20*a*.

In the transfer process, the primary transfer roller 20*b* transfers (primarily transfers) the electrostatic toner pattern formed on the photosensitive drum 20*a* onto the intermediate transfer belt 23. After the transfer of the electrostatic toner pattern, a small amount of residual toner remains on the photosensitive drum 20*a*.

In the cleaning process, the cleaning device, which is not illustrated, removes the residual toner remaining on the photosensitive drum 20*a*.

Because the copier 2 carries out monochrome copying in the present embodiment, one image forming unit is provided. If the copier 2 can carry out color copying, a plurality of image forming units are provided. The number of image forming units corresponds to the number of colors of toners to be used. In this case, the image forming units use respective toners of respective colors but have the same configuration and perform the same operation.

The intermediate transfer belt 23 is an endless belt stretched around a plurality of rollers including the driving rollers 21 and 22 and the repulsive roller 24. One of the driving rollers 21 and 22 is driven to rotate, thereby causing the intermediate transfer belt 23 to move endlessly.

The image forming unit 20 (the primary transfer roller 20*b*) transfers an electrostatic toner pattern onto the intermediate transfer belt 23. The intermediate transfer belt 23 then conveys the electrostatic toner pattern thus transferred to a space between the repulsive roller 24 and the secondary transfer roller 25. The paper feeding unit, which is not illustrated, or the like conveys a sheet P to a space between the repulsive roller 24 and the secondary transfer roller 25 in synchronization with the conveying timing of the electrostatic toner pattern. This causes the transfer position of the electrostatic toner pattern to coincide with the sheet P.

In the present embodiment, the sheet P is a piece of leather-like paper having low surface smoothness (whose surface is highly uneven) or a piece of plain paper having high surface smoothness (whose surface is less uneven), for example. The sheet P is not limited thereto.

The repulsive roller 24 (an example of the transfer unit) forms a secondary transfer nip (not illustrated) with the secondary transfer roller 25. The repulsive roller 24 transfers (secondarily transfers) the electrostatic toner pattern conveyed by the intermediate transfer belt 23 onto the sheet P at the secondary transfer nip. The repulsive roller 24 is connected to the secondary transfer power supply 100 serving as a power supply for a transfer bias. The secondary transfer roller 25 is grounded.

The secondary transfer power supply 100 applies a high voltage to the repulsive roller 24 at a timing when the repulsive roller 24 and the secondary transfer roller 25 perform secondary transfer. The toner is negatively charged in the copier 2 similarly to a typical image forming apparatus. The secondary transfer power supply 100 applies a negative high voltage to the repulsive roller 24, thereby applying a repulsive force to the toner and performing transfer.

The secondary transfer power supply 100 includes a DC power supply 110 and an AC power supply 140 connected in series to the DC power supply 110. The DC power supply 110 outputs a DC voltage to the AC power supply 140. The AC power supply 140 selectively outputs a superimposed voltage obtained by superimposing an AC voltage on the DC voltage output from the DC power supply 110 and the DC voltage output from the DC power supply 110 to the repulsive roller 24.

Specifically, the secondary transfer power supply 100 (AC power supply 140) applies the superimposed voltage or the DC voltage to the repulsive roller 24 in accordance with user settings. In the present embodiment, to use a piece of leather-like paper as the sheet P, a user makes in advance the user settings for applying the superimposed voltage to the repulsive roller 24. To use a piece of plain paper as the sheet P, the user makes in advance the user settings for applying the DC voltage to the repulsive roller 24.

This generates a potential difference between the repulsive roller 24 and the secondary transfer roller 25. As a result, a voltage is generated that causes the toner to move from the intermediate transfer belt 23 to the sheet P, thereby transferring the electrostatic toner pattern onto the sheet P. In other words, the repulsive roller 24 uses the voltage (superimposed voltage or DC voltage) output from the secondary transfer power supply 100 (AC power supply 140), thereby transferring the toner onto the sheet P.

To use a piece of leather-like paper having low surface smoothness as the sheet P, transfer is performed by causing the toner to move (oscillate) in two directions (a transfer direction and a direction opposite thereto) with the superimposed voltage. This can increase the transfer ratio of the toner onto recessed portions and prevent an uneven density and the like, thereby improving the image quality. To use a piece of plain paper having high surface smoothness as the sheet P, transfer is performed by causing the toner to move in the transfer direction with the DC voltage. This can suppress scattering of the toner and prevent a blur and the like on an image, thereby improving the image quality.

After the electrostatic toner pattern is transferred onto the sheet P, a fixing device, which is not illustrated, applies heat and pressure to the sheet P, thereby fixing the electrostatic toner pattern onto the sheet P. The sheet P on which the electrostatic toner pattern is fixed is discharged from the copier 2 to the 1-bin discharge tray 9 (refer to FIG. 1).

The power supply control unit 200 controls the power supply, which will be described later in detail.

Figure 3:
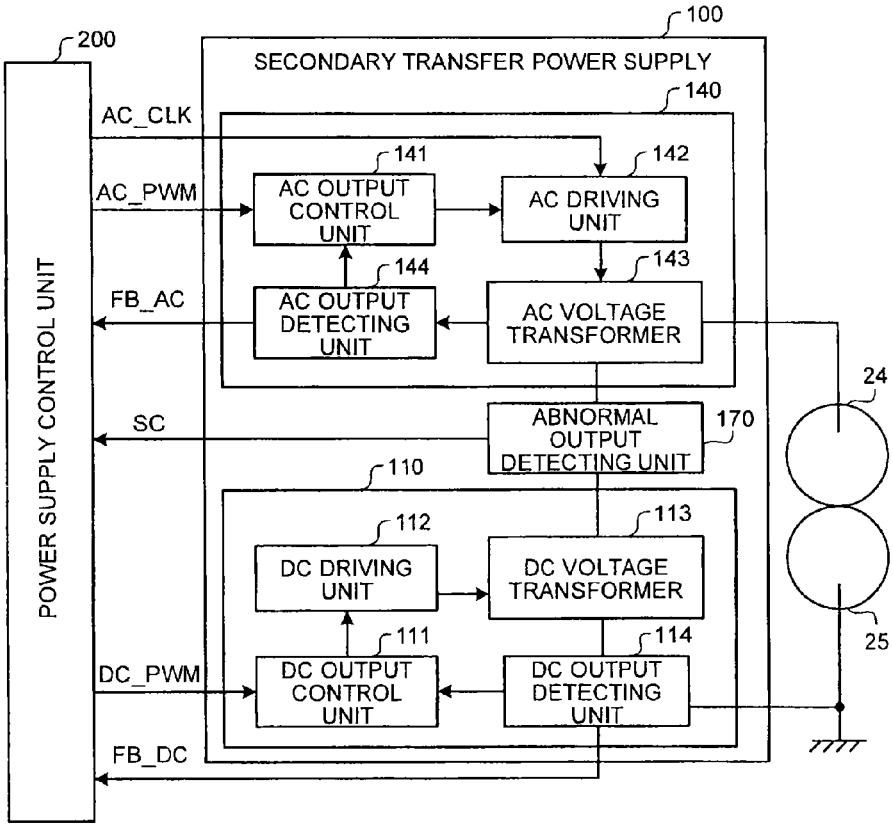
FIG. 3 is a block diagram of an example of an electrical configuration of the copier according to the embodiment.

FIG. 3 is a block diagram of an example of an electrical configuration of the copier 2 according to the present embodiment. As illustrated in FIG. 3, the copier 2 includes the secondary transfer power supply 100 and the power supply control unit 200.

The secondary transfer power supply 100 includes the DC power supply 110, the AC power supply 140, and an abnormal output detecting unit 170. The DC power supply 110 is a power supply for transfer of a toner. The DC power supply 110 includes a DC output control unit 111, a DC driving unit 112, a DC voltage transformer 113, and a DC output detecting unit 114.

The DC output control unit 111 receives a DC_PWM signal from the power supply control unit 200. The DC output control unit 111 also receives an output value of the DC voltage transformer 113 detected by the DC output detecting unit 114 from the DC output detecting unit 114. The DC_PWM signal is a pulse signal that controls the magnitude of output of a DC voltage. The amplitude (intensity) of the DC_PWM signal represents a DC(−) output value. The DC_PWM signal is an example of a first control signal.

The DC output control unit 111 controls driving of the DC voltage transformer 113 via the DC driving unit 112 based on the duty ratio and the DC(−) output value of the DC_PWM signal thus received and the output value of the DC voltage transformer 113. Thus, the DC output control unit 111 controls the DC voltage output from the DC voltage transformer 113.

Under the control of the DC output control unit 111, the DC driving unit 112 drives the DC voltage transformer 113. The DC voltage transformer 113 is driven by the DC driving unit 112 to output a negative DC high voltage (DC voltage) based on the duty ratio of the DC_PWM signal.

The DC driving unit 112 drives the DC voltage transformer 113 based on the DC(−) output value of the DC_PWM signal, thereby setting the DC voltage generated by the DC voltage transformer 113 to an arbitrary value. This controls a waveform of a voltage output from the AC power supply 140, which will be described later.

The DC output detecting unit 114 detects the output value of the DC high voltage (DC voltage) output from the DC voltage transformer 113 and transmits the output value to the DC output control unit 111. Furthermore, the DC output detecting unit 114 transmits the output value thus detected to the power supply control unit 200 as an FB_DC signal (a feedback signal). This processing is performed to cause the power supply control unit 200 to control the duty of the DC_PWM signal such that the transferability does not deteriorate because of the environment and loads.

The DC power supply 110 performs constant current control in the present embodiment. The DC power supply 110 does not necessarily perform constant current control and may perform constant voltage control. The DC power supply 110 only needs to be controlled based on the first control signal, and the above-described control method is just an example.

The AC power supply 140 is a power supply for oscillation of a toner. The AC power supply 140 includes an AC output control unit 141, an AC driving unit 142, an AC voltage transformer 143, and an AC output detecting unit 144.

The AC output control unit 141 receives an AC_PWM signal from the power supply control unit 200. The AC output control unit 141 also receives an output value of the AC voltage transformer 143 detected by the AC output detecting unit 144 from the AC output detecting unit 144. The AC_PWM signal is a pulse signal that controls the magnitude of output of an AC voltage. The AC_PWM signal is an example of a second control signal. The power supply control unit 200 changes and controls the AC_PWM signal having, as the AC voltage value, a target wave height of the voltage waveform to be output from the AC power supply 140, in accordance with print settings including the thickness of the sheet, the unevenness of the sheet, and the environmental information, so as to output the changed signal to the AC output control unit 141. Herein, the AC voltage value, which is the target wave height of the voltage waveform to be output from the AC power supply 140, is referred to as an AC(−) output value. In the present embodiment, the power supply control unit 200 changes the AC(−) output value, which is the target wave height value of the voltage waveform, in accordance with the print settings described above, and determines a duty ratio of the PWM signal based on the changed AC(−) output value, so as to output the AC_PWM signal to the AC output control unit 141. As a result, an actual output waveform having the wave height determined based on the duty ratio of the AC_PWM signal is output from the AC voltage transformer 143.

That is, the AC output control unit 141 controls driving of the AC voltage transformer 143 via the AC driving unit 142 based on the duty ratio of the AC_PWM signal. The AC voltage transformer 143 is driven to generate an AC voltage by the AC driving unit 142. The AC voltage transformer 143 superimposes the AC voltage thus generated on a DC high voltage output from the DC voltage transformer 113, thereby generating a superimposed voltage. The AC voltage transformer 143 outputs (applies) the superimposed voltage thus generated to the repulsive roller 24.

The AC driving unit 142 drives the AC voltage transformer 143 based on the duty ratio of the AC_PWM signal. Thus, the AC driving unit 142 sets the amplitude (wave height) of the output waveform of the voltage generated by the AC voltage transformer 143 to an arbitrary value. Furthermore, the AC driving unit 142 receives an AC_CLK signal. The AC_CLK signal is a signal for controlling an output frequency of an AC voltage. The AC_CLK signal is an example of a third control signal.

The AC driving unit 142 drives the AC voltage transformer 143 under the control of the AC output control unit 141 and based on the AC_CLK signal. The AC driving unit 142 drives the AC voltage transformer 143 based on the AC_CLK signal, thereby setting the output waveform generated by the AC voltage transformer 143 to an arbitrary frequency specified by the AC_CLK signal. That is, the wave height of the output waveform generated by the AC voltage transformer 143 is determined based on the duty ratio of the AC_PWM signal, and the output waveform generated by the AC voltage transformer 143 is determined based on the AC_CLK signal.

If the AC voltage transformer 143 generates no AC voltage, the AC voltage transformer 143 outputs (applies) the DC high voltage output from the DC voltage transformer 113 to the repulsive roller 24. The voltage (superimposed voltage or DC voltage) output to the repulsive roller 24 returns to the DC power supply 110 via the secondary transfer roller 25.

The AC output detecting unit 144 detects the output value of the AC voltage output from the AC voltage transformer 143 and transmits the output value to the AC output control unit 141. Furthermore, the AC output detecting unit 144 transmits the output value thus detected to the power supply control unit 200 as an FB_AC signal (a feedback signal). This processing is performed to cause the power supply control unit 200 to control the duty of the AC_PWM signal such that the transferability does not deteriorate because of the environment and loads.

The AC power supply 140 performs constant voltage control in the present embodiment. The AC power supply 140 does not necessarily perform constant voltage control and may perform constant current control.

The AC voltage generated by the AC voltage transformer 143 (AC power supply 140) may have either a sinusoidal waveform or a square waveform. In the present embodiment, the AC voltage has a short-pulse square waveform. Setting the waveform of the AC voltage to a short-pulse square wave can further improve the image quality.

Figure 4:
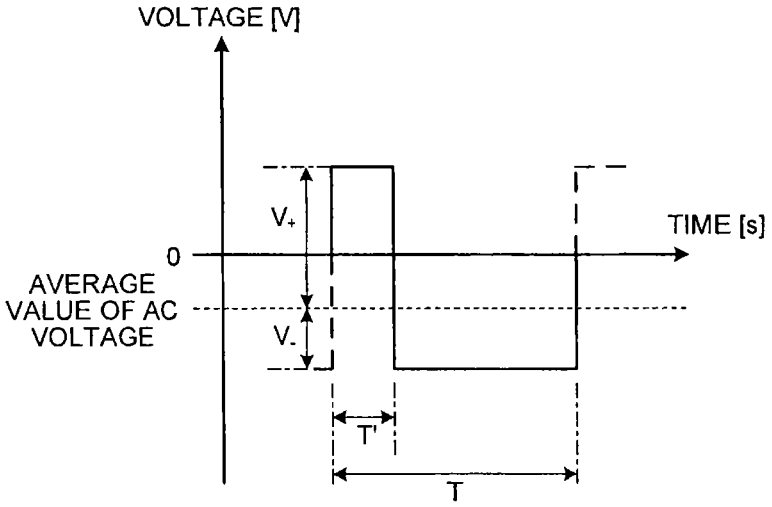
FIG. 4 is a view of an example of a superimposed voltage obtained by superimposing an AC voltage of a short-pulse square wave on a DC voltage according to the embodiment.
Figure 5:
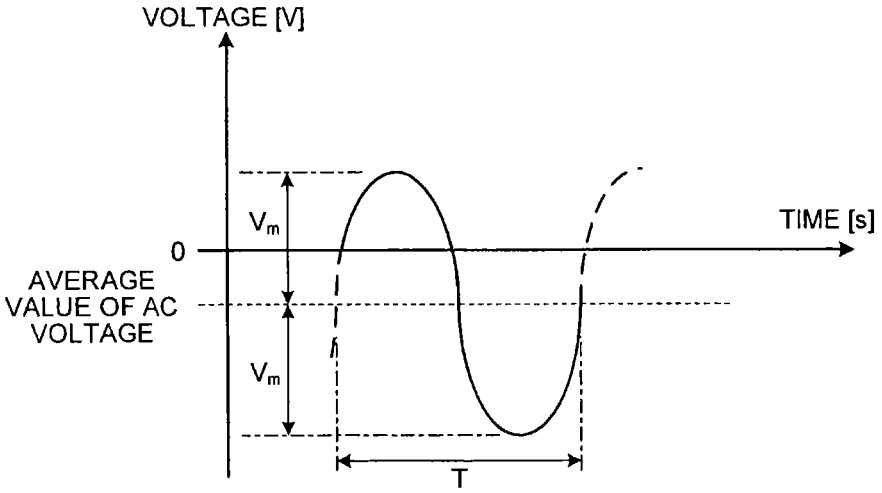
FIG. 5 is a view of an example of a superimposed voltage obtained by superimposing an AC voltage of a sinusoidal wave on a DC voltage according to the embodiment.

The following specifically describes advantageous effects of a short-pulse square wave compared with a sinusoidal wave. FIG. 4 is a view of an example of a superimposed voltage obtained by superimposing an AC voltage of a short-pulse square wave on a DC voltage. FIG. 5 is a view of an example of a superimposed voltage obtained by superimposing an AC voltage of a sinusoidal wave on a DC voltage.

Typically, an AC voltage can be represented by using time. The superimposed voltage illustrated in FIG. 4 can be expressed by Equations (1) and (2), whereas the superimposed voltage illustrated in FIG. 5 can be expressed by Equation (3):

$$V(s)=V_{+}(0\leq s\leq T') \tag{1}$$

$$V(s)=V_{-}(T'\leq s\leq T) \tag{2}$$

$$V(s)=V_m \sin \omega s \tag{3}$$

In Equations described above, s denotes time, $V_+$ denotes a positive increment in the pulse voltage, $V_-$ denotes a negative increment in the pulse voltage, T denotes a period of the waveform of the pulse voltage, and T' denotes a switching point of the polarity. Positive output energy of the pulse voltage is equal to negative output energy thereof, and the relation expressed by Equation (4) is satisfied.

$$V_{+}\times T'=V_{-}\times(T-T') \tag{4}$$

$V_m$ denotes the amplitude of a sinusoidal wave, and ω denotes the angular velocity.

The superimposed voltages illustrated in FIG. 4 and FIG. 5 are each obtained by superimposing an AC voltage on a negative DC voltage. As a result, positive electrical energy and negative electrical energy are periodically added to an average value (a negative value) of the superimposed voltage, which is a value of the negative DC voltage. Periodic addition of the positive electrical energy causes the toner to oscillate in the transfer direction and the direction opposite thereto, thereby increasing the amount of toner adhering to recessed portions on a sheet. Furthermore, periodic addition of the negative electrical energy increases the negative voltage, thereby making the negative voltage peak value smaller than the average value of the superimposed voltage.

If the negative voltage is excessively increased, aerial discharge occurs, thereby generating a void at the protruding portions on the sheet. To address this, the increment in the negative voltage is preferably smaller than the increment in the positive voltage. In the case of the superimposed voltage obtained by superimposing an AC voltage of a sinusoidal wave on a DC voltage as illustrated in FIG. 5, the increment in the voltage corresponds to the amplitude $V_m$ of the sinusoidal wave. This makes it difficult to control the increment as described above. In the present embodiment, the superimposed voltage is obtained by superimposing an AC voltage of a short-pulse square wave on a DC voltage as illustrated in FIG. 4. In addition, the increment $V_-$ in the negative voltage is smaller than the increment $V_+$ in the positive voltage. This prevents a void at the protruding portions on the sheet, thereby improving the image quality.

Supposing that the positive peak value of the superimposed voltage illustrated in FIG. 4 is equal to that of the superimposed voltage illustrated in FIG. 5 ($V_+=V_m$), $V_-$ is expressed by Equation (5):

$$V_{-}=V_m\times T'/(T-T') \tag{5}$$

The inventors found that setting T' to approximately 10 to 20% of T reduces a blur on an image. This is because of the following reason: reducing time for applying the positive voltage in the short-pulse square wave causes the toner to move quickly compared with application of the positive voltage in the sinusoidal wave, thereby reducing scattering of the toner.

In the present embodiment, the superimposed voltage is obtained by superimposing the AC voltage of the short-pulse square wave on the DC voltage, and T' is set to approximately 10 to 20% of T as illustrated in FIG. 4. Thus, according to the present embodiment, a blur on an image can be reduced, thereby improving the image quality.

While T' is set to approximately 10 to 20% of T, V_ is kept down to approximately 11 to 25% of $V_m$. As a result, the superimposed voltage illustrated in FIG. 4 can ensure a margin of approximately $V_m \times 3/4$ to $V_m \times 8/9$ on an aerial discharge voltage compared with the superimposed voltage illustrated in FIG. 5. Thus, according to the present embodiment, a void at the protruding portions on the sheet caused by aerial discharge can also be prevented.

Referring back to FIG. 3, the abnormal output detecting unit 170 is arranged on an output line of the secondary transfer power supply 100. If abnormal output occurs because of a ground fault of an electric wire, for example, the abnormal output detecting unit 170 outputs an SC signal to the power supply control unit 200. This enables the power supply control unit 200 to perform control for stopping output of a high voltage from the secondary transfer power supply 100.

Figure 6:
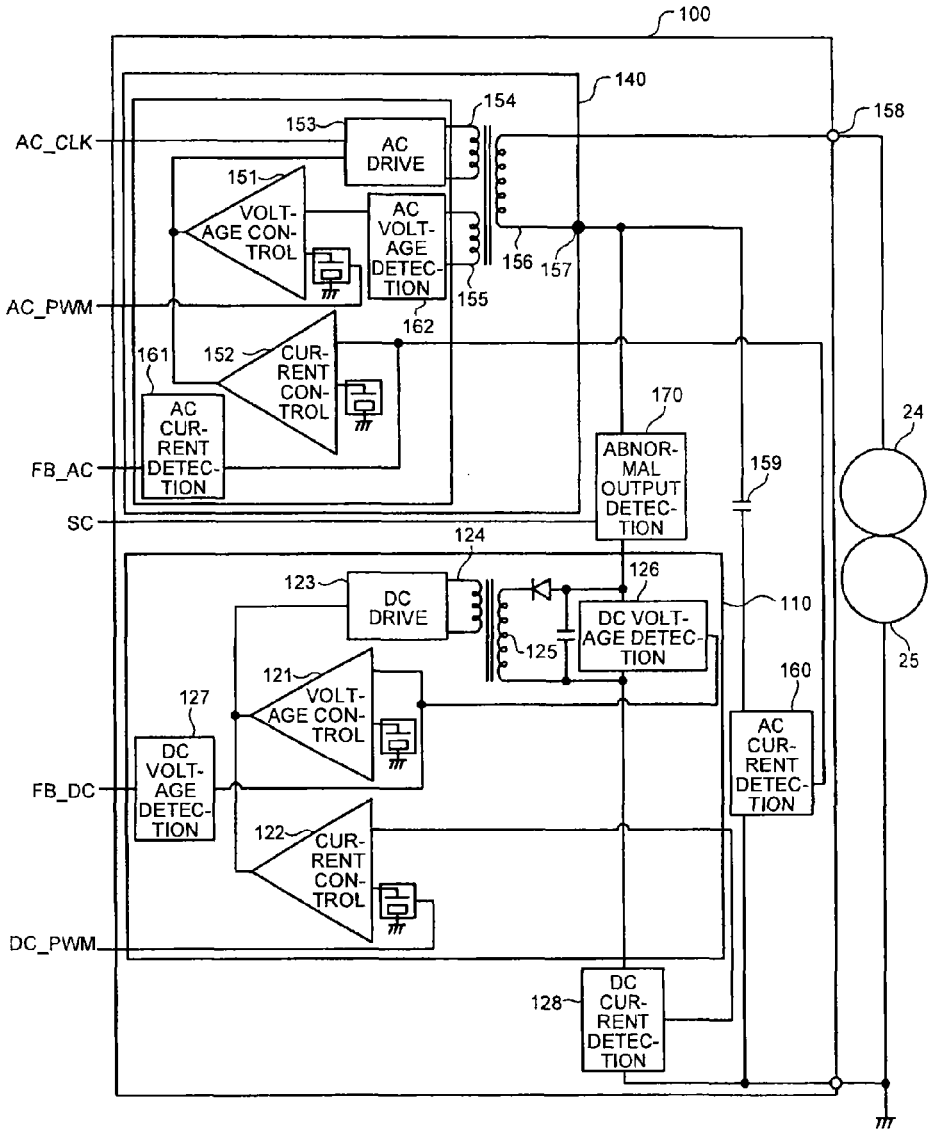
FIG. 6 is a circuit diagram of an example of a configuration of a secondary transfer power supply according to the embodiment.

FIG. 6 is a circuit diagram of an example of a configuration of the secondary transfer power supply 100 according to the present embodiment.

The DC power supply 110 receives a DC_PWM signal from the power supply control unit 200. The DC_PWM signal thus received is integrated and input to a current control circuit 122 (comparator). The value of the DC_PWM signal thus integrated is a reference current in the current control circuit 122. A DC current detecting circuit 128 detects a DC current output from the DC power supply 110 on the output line of the secondary transfer power supply 100. The DC current detecting circuit 128 then inputs the output value of the DC current thus detected to the current control circuit 122. If the DC current is lower than the reference current, the current control circuit 122 actively drives a DC driving circuit 123 of a DC high-voltage transformer. If the DC current is higher than the reference current, the current control circuit 122 suppresses driving of the DC driving circuit 123 of the DC high-voltage transformer. This enables the DC power supply 110 to ensure a constant current.

A DC voltage detecting circuit 126 detects a DC voltage output from the DC power supply 110 and inputs the output value of the DC voltage thus detected to a voltage control circuit 121 (comparator). If the output value of the DC voltage reaches the upper limit, the voltage control circuit 121 suppresses driving of the DC driving circuit 123 of the DC high-voltage transformer. A DC voltage detecting circuit 127 feeds back the output value of the DC voltage detected by the DC voltage detecting circuit 126 to the power supply control unit 200 as an FB_DC(−) signal.

By driving of the DC driving circuit 123 under the control of the current control circuit 122 and the voltage control circuit 121, output generated by a primary winding N1_DC(−) 124 of the DC high-voltage transformer and a secondary winding N2_DC(−) 125 of the DC high-voltage transformer is smoothed by a diode and a capacitor. Subsequently, the output is input to the AC power supply 140 via an AC power supply input unit 157 as a DC voltage and applied to a secondary winding N2_AC 156 of the AC voltage transformer 143.

The AC power supply 140 receives an AC_PWM signal from the power supply control unit 200, and the AC_PWM signal is input to a voltage control circuit 151 (comparator). The value of the AC_PWM signal thus received is a reference voltage in the voltage control circuit 151. An AC voltage detecting circuit 162 predicts the output value of an AC voltage from a mutual induction voltage generated by a primary winding N3_AC 155 of the AC voltage transformer 143. The AC voltage detecting circuit 162 then inputs the output value of the AC voltage thus predicted to the voltage control circuit 151. This is because of the following reason: it is difficult to detect only the output (AC voltage) of the AC power supply 140 itself on the output line of the secondary transfer power supply 100 because the AC voltage is superimposed on the DC voltage. If the AC voltage is lower than the reference voltage, the voltage control circuit 151 actively drives an AC driving circuit 153 of the AC voltage transformer 143. If the AC voltage is higher than the reference voltage, the voltage control circuit 151 suppresses driving of the AC driving circuit 153 of the AC voltage transformer 143. This enables the AC power supply 140 to ensure a constant voltage.

An AC current detecting circuit 160 detects an AC current on the low-tension side of an AC bypass capacitor 159 serving as the output line of the secondary transfer power supply 100. The AC current detecting circuit 160 then inputs the output value of the AC current thus detected to a current control circuit 152 (comparator). If the output value of the AC current reaches the upper limit, the current control circuit 152 suppresses driving of the AC driving circuit 153 of the AC voltage transformer 143. An AC current detecting circuit 161 feeds back the output value of the AC current thus detected to the power supply control unit 200 as an FB_AC signal.

The AC driving circuit 153 of the AC voltage transformer 143 drives based on an AC_CLK signal received from the power supply control unit 200 and logical conjunction of the voltage control circuit 151 and the current control circuit 152. Thus, the AC driving circuit 153 generates output having the same period as that of AC_CLK.

The AC voltage generated at a primary winding N1_AC 154 of the AC voltage transformer 143 by driving of the AC driving circuit 153 is superimposed on the DC voltage applied to the secondary winding N2_AC 156. The superimposed voltage thus obtained is output (applied) to the repulsive roller 24 via a high-voltage output unit 158. If the AC power supply 140 is not driven, the DC voltage applied to the secondary winding N2_AC 156 is output (applied) to the repulsive roller 24 without any change via the high-voltage output unit 158.

Referring back to FIG. 3, the power supply control unit 200 controls the secondary transfer power supply 100. The power supply control unit 200 is formed of a control device including a central processing unit (CPU), a read-only memory (ROM), and a random access memory (RAM), for example.

The power supply control unit 200 is provided with an input-output (IO) control unit (not illustrated). A memory of the IC control unit stores therein print settings serving as conditions relating to image formation. Examples of the print settings include a print speed mode, the thickness of a sheet, environmental information, and the unevenness of a sheet.

The print speed mode indicates the speed of printing including low speed, medium speed, and high speed. The thickness of a sheet is a value indicating the level of thickness, and a larger value indicates a thicker sheet. The environmental information indicates the installation environment of the image forming apparatus, and any one of low-temperature and low-humidity, low-temperature and high-humidity, normal, high-temperature and low-humidity, and high-temperature and high-humidity is set depending on the setting environment. The unevenness of a sheet is a value indicating the level of unevenness, and a larger value indicates a more uneven sheet. The print settings are made by the user through an operation panel and changed when printer-driver settings are changed, for example.

When receiving a print instruction, the power supply control unit 200 reads the print settings from the memory to change and control the DC_PWM signal and the AC_PWM signal in accordance with the print settings thus read.

Specifically, to change the waveform of the output voltage from the AC power supply 140 in accordance with the print settings including the print speed mode, the thickness of the sheet, and the environmental information, the power supply control unit 200 determines the DC(−) output value of the DC_PWM signal based on the print speed mode, the thickness of the sheet, and the environmental information. Thus, the power supply control unit 200 changes and controls the DC_PWM signal.

Furthermore, the power supply control unit 200 determines the duty ratio of the DC_PWM signal based on the DC(−) output value and the DC voltage represented by the FB_DC signal received from the DC output detecting unit 114 of the DC power supply 110. The power supply control unit 200 outputs the DC_PWM signal thus changed to the DC output control unit 111 of the DC power supply 110. The power supply control unit 200 then outputs the DC_PWM signal thus determined to the DC output control unit 111 of the DC power supply 110.

FIGS. 7A to 7D are views illustrating examples of setting for the DC(−) output value and the duty ratio of the DC_PWM signal in accordance with the print settings. The power supply control unit 200 determines the DC(−) output value and the duty ratio of the DC_PWM signal in accordance with the examples of FIGS. 7A to 7D.

The DC power supply 110 employs constant current control. As the print speed increases and the thickness of the sheet increases, the DC power supply 110 needs to increase the current. Furthermore, the DC power supply 110 needs to change the current value depending on the environment of the image forming apparatus. In the examples of FIGS. 7A to 7C, the DC power supply 110 multiplies the DC(−) output value by a constant based on a prior inspection and the like, thereby correcting and controlling the DC(−) output value. In the examples of FIGS. 7A to 7C, the numerical values correspond to the constant. While the voltage value is changed by the load, the voltage value is 100 MΩ in these examples.

FIG. 7A illustrates an example of the DC(−) output value depending on the print speed mode. As illustrated in FIG. 7A, the power supply control unit 200 performs control such that the DC(−) output value increases as the print speed mode shifts from low speed to high speed. FIG. 7B illustrates an example of the DC(−) output value depending on the thickness of the sheet. As illustrated in FIG. 7B, the power supply control unit 200 performs control such that the DC(−) output value increases as the thickness of the sheet increases. FIG. 7C illustrates an example of the DC(−) output value depending on the environmental information. As illustrated in FIG. 7C, the power supply control unit 200 performs control such that the DC(−) output value increases as the environment shifts from low temperature to high temperature and from low humidity to high humidity.

FIG. 7D illustrates an example of the duty ratio of the DC_PWM signal corresponding to the DC(−) output value thus determined. As illustrated in FIG. 7D, the power supply control unit 200 performs control such that the duty ratio of the DC_PWM signal increases as the DC(−) output value decreases.

To change the waveform of the output voltage from the AC power supply 140 in accordance with the print settings including the thickness of the sheet, the unevenness of the sheet, and the environmental information, the power supply control unit 200 determines the AC(−) output value based on the thickness of the sheet, the unevenness of the sheet, and the environmental information. Thus, the power supply control unit 200 controls the AC_PWM signal. The power supply control unit 200 then outputs the AC_PWM signal thus determined to the AC output control unit 144 of the AC power supply 140.

To change the waveform of the output voltage from the AC power supply 140 in accordance with the print speed included in the print settings, the power supply control unit 200 changes and controls the frequency of the AC_CLK signal. Furthermore, the power supply control unit 200 determines the duty ratio of the AC_CLK signal based on the AC(−) output value thus determined and the output voltage from the AC voltage transformer 143 represented by the FB_AC signal received from the AC output detecting unit 144 of the AC power supply 140. The power supply control unit 200 then outputs the AC_CLK signal thus determined to the AC driving unit 142 of the AC power supply 140.

FIGS. 8A to 8E are views illustrating examples of setting for the frequency of the AC_CLK signal in accordance with the print settings, the AC(−) output value in accordance with the print settings, and the duty ratio of the AC_PWM signal. The power supply control unit 200 determines and controls the AC(−) output value of the AC_PWM signal, the duty ratio of the AC_PWM signal and the frequency of the AC_CLK signal in accordance with the examples of FIGS. 8A to 8E.

FIG. 8A illustrates an example of setting of the frequency of the AC_CLK signal depending on the print speed mode. As illustrated in FIG. 8A, the power supply control unit 200 performs control such that the frequency of the AC_CLK signal increases as the print speed mode shifts from low speed to high speed. As described above, the AC(−) output value is the target wave height value of the output waveform output from the AC power supply 140. The AC power supply 140 changes the AC(−) output value in accordance with FIGS. 8B to 8D, determines the duty ratio of the AC_PWM signal based on the changed AC(−) output value, and controls the wave height of the actual output waveform based on the duty ratio of the PWM signal. FIG. 8B illustrates an example of the AC(−) output value depending on the thickness of the sheet. As illustrated in FIG. 8B, the power supply control unit 200 changes and controls the AC(−) output value such that the AC(−) output value increases as the thickness of the sheet increases. FIG. 8C illustrates an example of the AC(−) output value depending on the environmental information. As illustrated in FIG. 8C, the power supply control unit 200 changes and controls the AC(−) output value such that the AC(−) output value increases as the environment shifts from low temperature to high temperature and from low humidity to high humidity. FIG. 8D illustrates an example of the AC(−) output value depending on the unevenness of the sheet. As illustrated in FIG. 8D, the power supply control unit 200 changes and controls the AC(−) output value such that the AC(−) output value increases as the unevenness increases.

FIG. 8E illustrates an example of the duty ratio of the AC_CLK signal corresponding to the AC(−) output value thus changed. As illustrated in FIG. 8E, the power supply control unit 200 performs control such that the duty ratio of the AC_CLK signal increases as the AC(−) output value increases.

As described above, the power supply control unit 200 changes and controls the DC(−) output value and the duty ratio of the DC_PWM signal, the AC(−) output value, the duty ratio of the AC_PWM signal, and the frequency of the AC_CLK signal in accordance with the print settings and the like. The power supply control unit 200 then transmits the signals to the secondary transfer power supply 100.

In the secondary transfer power supply 100, the DC voltage transformer 113 of the DC power supply 110 outputs a DC voltage having an amplitude corresponding to the DC(−) output value of the DC_PWM signal changed by the power supply control unit 200. The AC voltage transformer 143 of the AC power supply 140 selectively outputs either of the superimposed voltage or the DC voltage, with a waveform having an amplitude corresponding to the duty ratio of the AC_PWM signal changed and controlled by the power supply control unit 200. Furthermore, the AC voltage transformer 143 of the AC power supply 140 changes and controls the frequency of the output voltage depending on the frequency of the AC_CLK signal. As a result, the waveform of the voltage output from the AC power supply 140 is changed into an arbitrary waveform and output in accordance with the print settings (the print speed mode, the thickness of the sheet, the environmental information, and the unevenness of the sheet).

Figure 9:
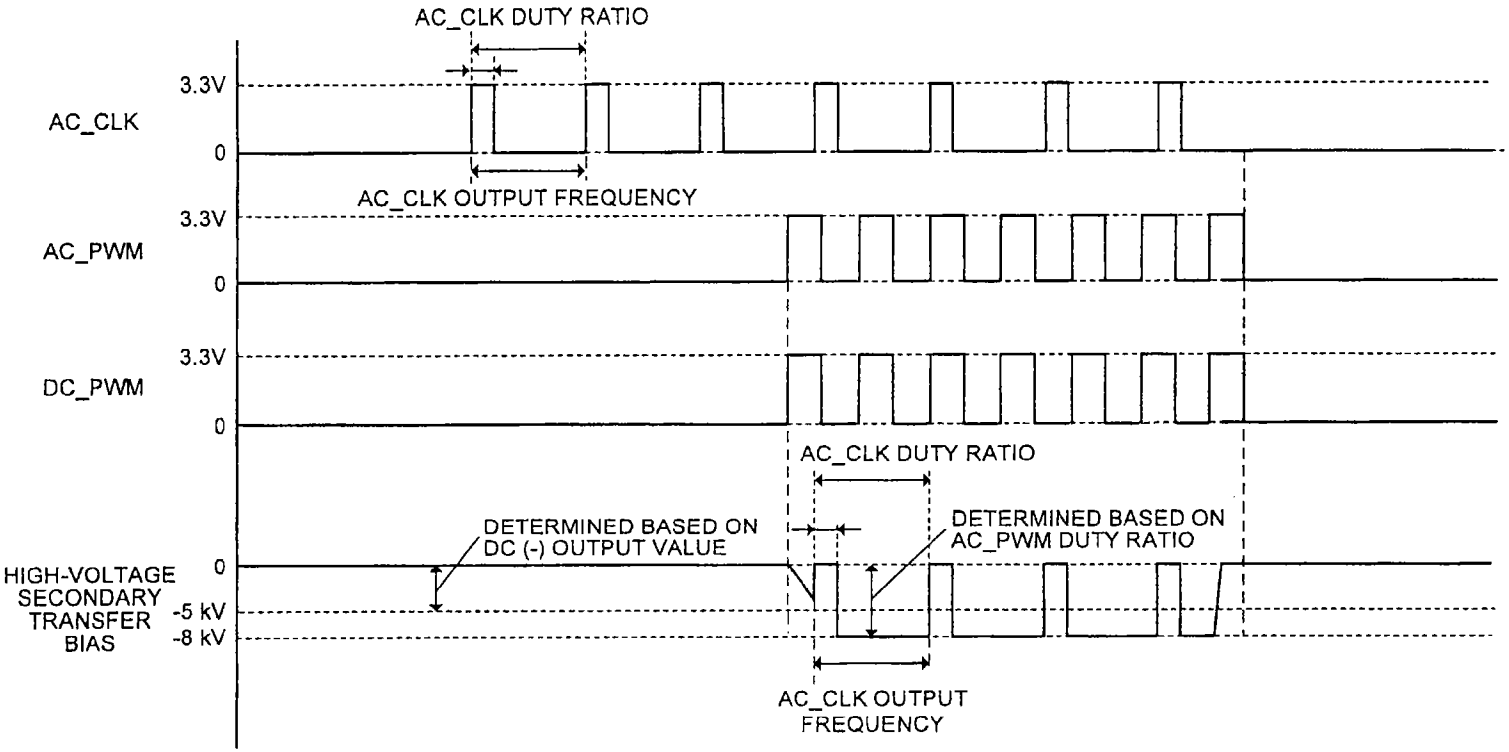
FIG. 9 is a view for explaining a voltage waveform of a square wave output from an AC power supply according to the embodiment.

FIG. 9 is a view for explaining a voltage waveform of a square wave (application of a square-wave high-voltage secondary transfer bias) output from the AC power supply 140 according to the present embodiment. A voltage is amplified by a winding and converted into a high-voltage power supply with the AC_CLK signal and the AC_PWM signal, whereby the square wave illustrated in FIG. 4 is generated. Furthermore, the voltage is offset in one direction with the DC_PWM signal, whereby a high-voltage secondary transfer bias is output. Thus, the toner is transferred onto the sheet as illustrated in FIG. 2. While the explanation is made of the square wave in this example, the same applies to a sinusoidal wave or a triangle wave.

As illustrated in the example of FIG. 9, an offset of the high-voltage secondary transfer bias is determined based on the DC(−) output value of the DC_PWM signal, and the wave height value of the voltage output waveform of the square wave is determined based on the duty ratio of the AC_PWM signal. The frequency of the voltage waveform of the square wave output from the AC power supply 140 is determined based on the output frequency of the AC_CLK signal. The pulse width of the voltage waveform of the square wave output from the AC power supply 140 is determined based on the duty ratio of the AC_CLK signal. That is, the voltage waveform output from the AC power supply 140 is determined based on the AC_CLK signal, and the wave height (amplitude) of the voltage waveform is determined based on the duty ratio of the AC_PWM signal.

Figure 10:
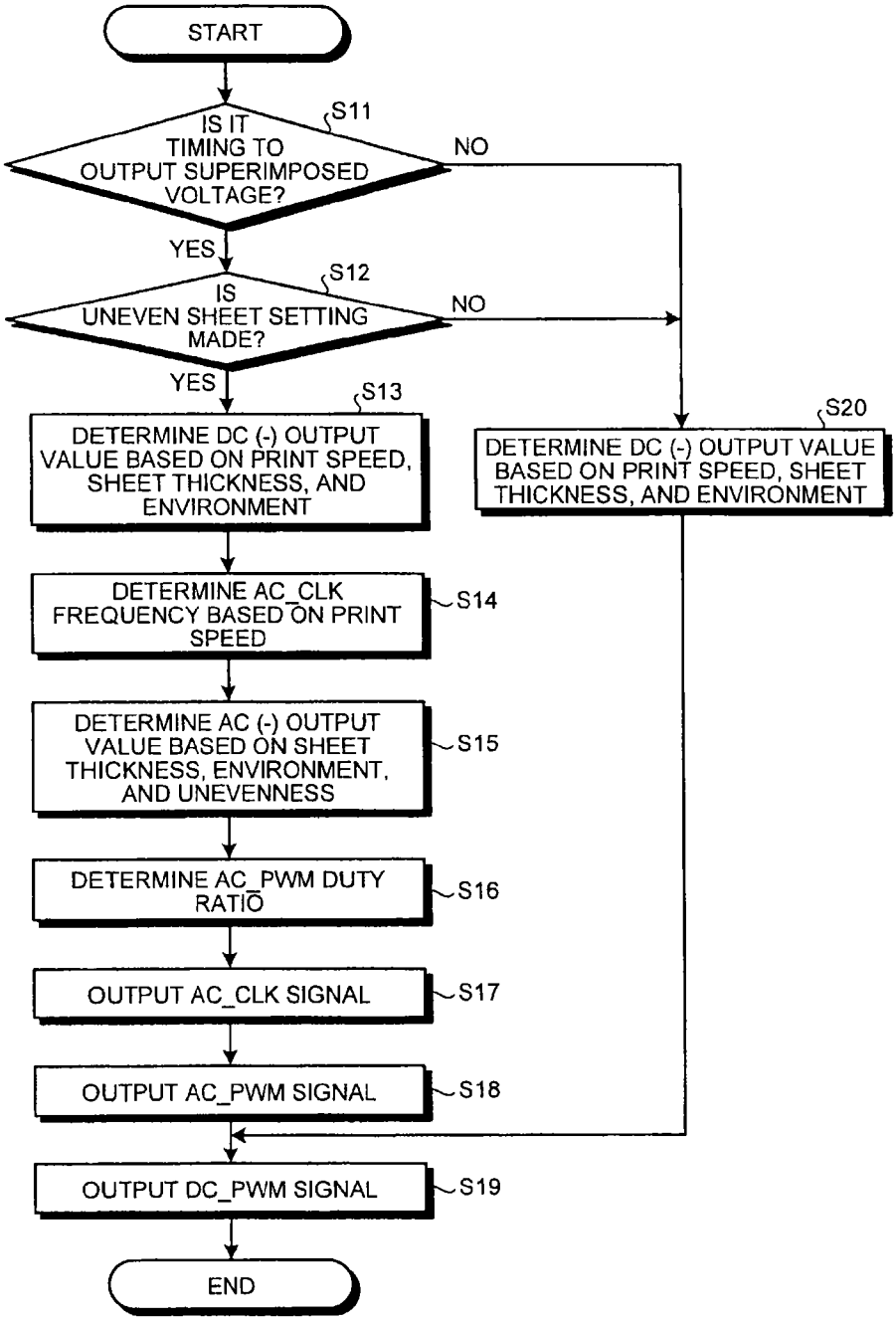
FIG. 10 is a flowchart of a process of power supply control processing according to the embodiment.

The following describes power supply control processing according to the present embodiment configured as described above. FIG. 10 is a flowchart of a process of the power supply control processing according to the present embodiment. The power supply control unit 200 determines whether it is a timing at which the AC power supply 140 outputs a superimposed voltage (Step S11). If it is not a timing to output a superimposed voltage (No at Step S11), the power supply control unit 200 determines the DC(−) output value based on the print speed, the sheet thickness, and the environmental information in accordance with FIGS. 7A to 7C (Step S20). The power supply control unit 200 turns ON and outputs the DC_PWM signal (Step S19) and outputs no AC_PWM signal. In other words, the power supply control unit 200 performs control so as to superimpose no AC voltage on the DC voltage.

By contrast, if it is a timing to output the superimposed voltage at Step S11 (Yes at Step S11), the power supply control unit 200 refers to the print settings stored in the memory and determines whether uneven sheet setting is made (Step S12). If the uneven sheet setting is not made (No at Step S12), the power supply control unit 200 determines the DC(−) output value based on the print speed, the sheet thickness, and the environmental information in accordance with FIGS. 7A to 7C (Step S20). The power supply control unit 200 turns ON and outputs the DC_PWM signal (Step S19). In other words, the power supply control unit 200 performs control so as to superimpose no AC voltage on the DC voltage in this case as well.

By contrast, if the uneven sheet setting is made at Step S12 (Yes at Step S12), the power supply control unit 200 determines the DC(−) output value based on the print speed, the sheet thickness, and the environment in accordance with FIGS. 7A to 7C (Step S13).

In the case where the print speed mode is medium speed, the sheet thickness is 4 (plain paper), and the environment is normal (that is, in the case of DC(−) output value×1), for example, the DC(−) output value is set to −40 μA. If the print speed mode is shifted to high speed in this case, the power supply control unit 200 calculates the DC(−) output by −40 μA×1.2=−48 μA in accordance with FIG. 7A. Thus, the DC(−) output value is changed to the corrected value. If other print setting values are changed, the power supply control unit 200 similarly multiplies the DC(−) output value corresponding to the normal environment by constants corresponding to the print settings illustrated in FIGS. 7A to 7C. Thus, the power supply control unit 200 determines the corrected DC(−) output value. Based on the DC(−) output value thus determined, the power supply control unit 200 refers to FIG. 7D, thereby determining the duty ratio of the DC_PWM signal to be 48%.

Subsequently, the power supply control unit 200 determines the AC_CLK frequency based on the print speed in accordance with FIG. 8A (Step S14).

Then, the power supply control unit 200 changes the AC(−) output value, which is a target wave height of the output waveform, based on the sheet thickness, the environmental information, and the unevenness of the sheet in accordance with FIGS. 8B to 8D (Step S15). Then, based on the AC(−) output value, the power supply control unit 200 determines the duty ratio of the AC_PWM signal in accordance with FIG. 8E (Step S16).

To perform transfer on the sheet, the power supply control unit 200 turns ON and outputs the AC_CLK signal (Step S17), turns ON and outputs the AC_PWM signal (Step S18), and turns ON and outputs the DC_PWM signal (Step S19).

Figure 12:
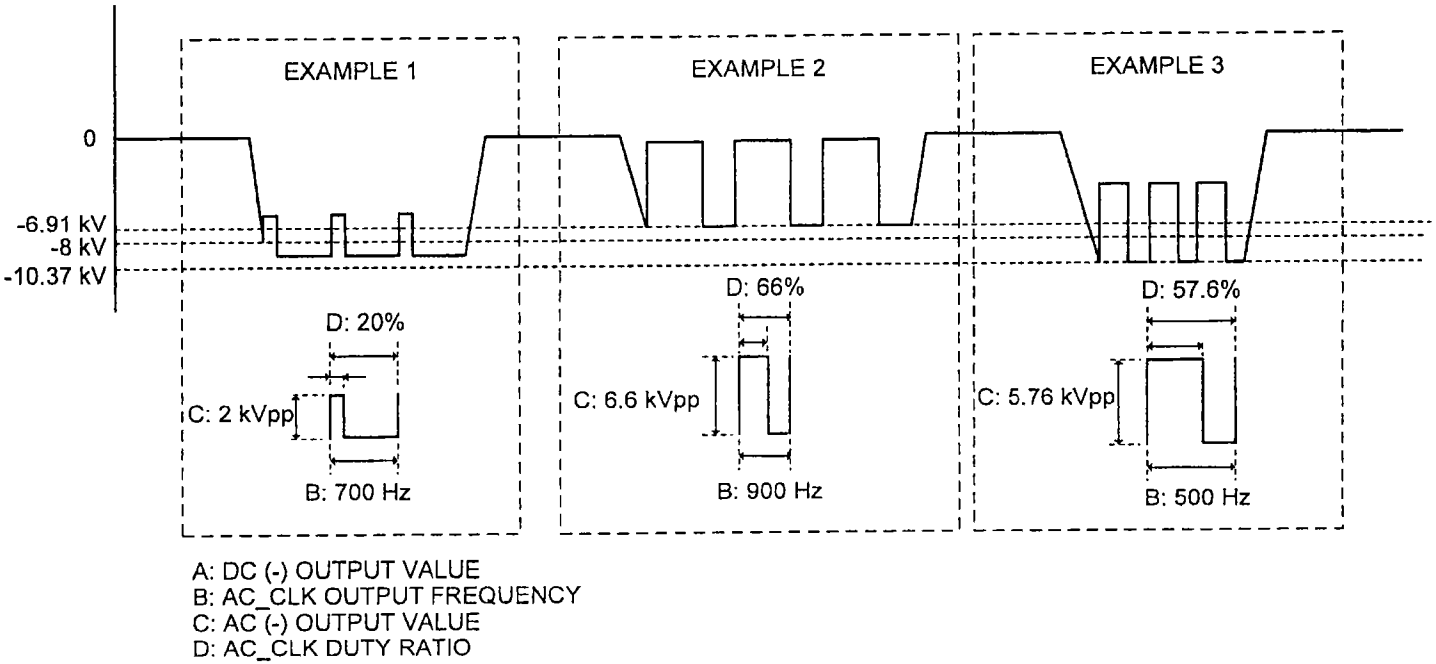
FIG. 12 is a view of waveforms of voltages output from the AC power supply in Example 1 to Example 3 of FIGS. 11A to 11C.

The following describes examples of the frequency set value of the AC_CLK signal, the AC(−) output value, the duty ratio of the AC_PWM signal, and the DC(−) output value determined depending on the print settings. FIGS. 11A to 11C illustrate examples of print settings and examples of the frequency set value of the AC_CLK signal, the AC(−) output value, the duty ratio of the AC_PWM signal, and the DC(−) output value determined depending on the print settings as Example 1 to Example 3, respectively. FIG. 12 is a view of waveforms of the voltages output from the AC power supply 140 in Example 1 to Example 3 of FIGS. 11A to 11C.

In Examples 1 to 3 of FIGS. 11A to 11C, the DC(−) output value is 80 μA, and the AC(−) output value which is set as a target wave height of the output waveform is 2 kVpp. If it is set in the memory that the print speed mode is medium speed, that the sheet thickness is 4, that the environment information is normal, and that the unevenness is 1 as illustrated in Example 1 of FIG. 11A, the power supply control unit 200 changes the DC(−) output value to be −80 μA based on FIGS. 7A to 7C. Specifically, a print speed mode of medium speed corresponds to DC(−) output value×1 in FIG. 7A, a sheet thickness of 4 corresponds to DC(−) output value×1 in FIG. 7B, and environment of normal corresponds to DC(−) output value×1 in FIG. 7C. Thus, the power supply control unit 200 calculates the DC(−) output value as follows: −80 μA×1 (print speed mode)×1 (sheet thickness)×1 (environment)=−80 μA.

Because the print speed mode is medium speed in Example 1, the power supply control unit 200 determines the frequency of the AC_CLK signal to be 700 Hz based on FIG. 8A. Furthermore, because the sheet thickness is 4, the environment is normal, and the unevenness is 1, the power supply control unit 200 changes the AC(−) output value to be 2 kVpp, which is set as the target wave height of the output value, in accordance with FIGS. 8B to 8D. Specifically, a sheet thickness of 4 corresponds to AC(−) output value×1 in FIG. 8B, environment of normal corresponds to AC(−) output value×1 in FIG. 8C, and unevenness of 1 corresponds to AC(−) output value×1 based on FIG. 8D. Thus, the power supply control unit 200 calculates the AC(−) output value as follows: 2 kVpp×1 (sheet thickness)×1 (environment)×1 (unevenness)=2 kVpp. Furthermore, the power supply control unit 200 determines the duty ratio of the AC_PWM signal to be 20%, which corresponds to an AC(−) output value of 2 kVpp in FIG. 8E. As a result, the high-voltage output waveform illustrated in Example 1 of FIG. 12 is formed and output from the AC voltage transformer 143 of the AC power supply 140.

If it is set in the memory that the print speed mode is high speed, that the sheet thickness is 6, that the environment is high temperature and high humidity, and that the unevenness is 4 as illustrated in Example 2 of FIG. 11B, the power supply control unit 200 changes the DC(−) output value to be −126.7 μA based on FIGS. 7A to 7C. Specifically, a print speed mode of high speed corresponds to DC(−) output value×1.2 in FIG. 7A, a sheet thickness of 6 corresponds to DC(−) output value×1.2 in FIG. 7B, and environment of high temperature and high humidity corresponds to DC(−) output value×1.1 in FIG. 7C. Thus, the power supply control unit 200 calculates the DC(−) output value as follows: −80 μA×1.2 (print speed mode)×1.2 (sheet thickness)×1.1 (environment)=−126.7 μA.

Because the print speed mode is high speed in Example 2, the power supply control unit 200 determines the frequency of the AC_CLK signal to be 900 Hz based on FIG. 8A. Furthermore, because the sheet thickness is 6, the environment is high temperature and high humidity, and the unevenness is 4, the power supply control unit 200 changes the AC(−) output value to be 6.6 kVpp, which is set as the target wave height of the output waveform, in accordance with FIGS. 8B to 8D. Specifically, a sheet thickness of 6 corresponds to AC(−) output value×1.2 in FIG. 8B, environment of high temperature and high humidity corresponds to AC(−) output value−1.1 in FIG. 8C, and unevenness of 4 corresponds to AC(−) output value×2.5 based on FIG. 8D. Thus, the power supply control unit 200 calculates the AC(−) output value as follows: 2 kVpp×1.2 (sheet thickness)×1.1 (environment)×2.5 (unevenness)=6.6 kVpp. Furthermore, the power supply control unit 200 determines the duty ratio of the AC_PWM signal to be 66% based on an AC(−) output value of 6.6 kVpp and FIG. 8E. As a result, the high-voltage output waveform illustrated in Example 2 of FIG. 12 is formed and output from the AC voltage transformer 143 of the AC power supply 140.

If it is set in the memory that the print speed mode is low speed, that the sheet thickness is 2, that the environment is low temperature and low humidity, and that the unevenness is 7 as illustrated in Example 3 of FIG. 11C, the power supply control unit 200 changes the DC(−) output value to be −46.1 μA based on FIGS. 7A to 7C. Specifically, a print speed mode of low speed corresponds to DC(−) output value×0.8 in FIG. 7A, a sheet thickness of 2 corresponds to DC(−) output value×0.8 in FIG. 7B, and environment of low temperature and low humidity corresponds to DC(−) output value×0.9 in FIG. 7C. Thus, the power supply control unit 200 calculates the DC(−) output value as follows: −80 μA×0.8 (print speed mode)×0.8 (sheet thickness)×0.9 (environment)=−46.1 μA.

Because the print speed mode is low speed in Example 3, the power supply control unit 200 determines the frequency of the AC_CLK signal to be 500 Hz based on FIG. 8A. Furthermore, because the sheet thickness is 2, the environment is low temperature and low humidity, and the unevenness is 7, the power supply control unit 200 changes the AC(−) output value to be 5.76 kVpp, which is set as the target wave height of the output waveform, in accordance with FIGS. 8B to 8D. Specifically, a sheet thickness of 2 corresponds to AC(−) output value×0.8 in FIG. 8B, environment of low temperature and low humidity corresponds to AC(−) output value×0.9 in FIG. 8C, and unevenness of 7 corresponds to AC(−) output value×4.0 based on FIG. 8D. Thus, the power supply control unit 200 calculates the AC(−) output value as follows: 2 kVpp×0.8 (sheet thickness)×0.9 (environment)×4.0 (unevenness)=5.76 kVpp. Furthermore, the power supply control unit 200 determines the duty ratio of the AC_PWN signal to be 57.6% based on an AC(−) output value of 5.76 kVpp and FIG. 8E. As a result, the high-voltage output waveform illustrated in Example 3 of FIG. 12 is formed and output from the AC voltage transformer 143 of the AC power supply 140. This forms the high-voltage output waveform illustrated in Example 3 of FIG. 12.

In this way, the power supply control unit 200 determines the frequency set value of the AC_CLK signal, the duty ratio of the AC_PWM signal, and the DC(−) output value depending on the print settings. The power supply control unit 200 then transmits the AC_CLK signal, the AC_PWM signal, and the DC_PWM signal to the secondary transfer power supply 100. Based on the AC_CLK signal, the AC_PWM signal, and the DC_PWM signal determined depending on the print settings, the secondary transfer power supply 100 outputs a high-voltage secondary transfer bias, thereby transferring a toner image.

Figure 13:
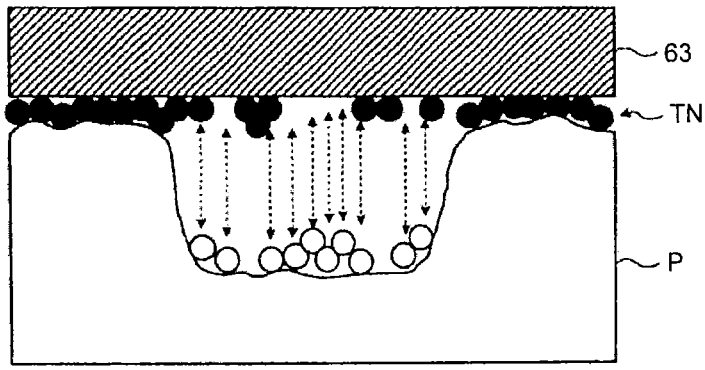
FIG. 13 is a view for explaining a principle of toner adhesion to a recording sheet P when the secondary transfer power supply applies a superimposed bias to a secondary transfer unit facing roller according to the embodiment.

FIG. 13 is a view for explaining a principle of toner adhesion to a recording sheet P when the secondary transfer power supply 100 applies a superimposed voltage (a superimposed bias) to a secondary transfer unit facing roller 63 according to the present embodiment. If a superimposed voltage is applied to the secondary transfer unit facing roller 63, the superimposed voltage has an AC waveform. This switches a voltage traveling from the secondary transfer unit facing roller 63 to a secondary transfer roller and a voltage traveling from the secondary transfer roller to the secondary transfer unit facing roller 63 with a particular period.

As a result, a toner TN of a full-color toner image formed on an intermediate transfer belt moves in a direction toward the recording sheet P and a direction opposite thereto as illustrated in FIG. 13. If the voltage reaches a certain level, the toner adheres to recessed portions on the recording sheet P.

While only the three conditions of the sheet thickness, the unevenness, and the environment are explained as the conditions that significantly affect the image quality on an uneven sheet in the embodiment described above, the conditions are not limited thereto. The AC voltage can vary depending on other parameters.

As described above, in the present embodiment, the secondary transfer power supply 100 includes the DC power supply 110 and the AC power supply 140 connected in series to the DC power supply 110. The AC power supply 140 selectively outputs the superimposed voltage obtained by superimposing the AC voltage on the DC voltage output from the DC power supply 110 and the DC voltage output from the DC power supply 110. The voltage output from the AC power supply 140 is used to transfer a toner onto a sheet.

In the present embodiment, the power supply control unit 200 determines the DC(−) output value of the DC_PWM signal, the AC(−) output value, the duty ratio of the AC_PWM signal, and the frequency of the AC_CLK signal depending on the print settings. The power supply control unit 200 then transmits the DC_PWM signal, the AC_PWM signal, and the AC_CLK signal having the values thus determined to the secondary transfer power supply 100. The secondary transfer power supply 100 outputs the voltage having a voltage waveform determined based on the DC_PWM signal, the AC_PWM signal, and the AC_CLK signal thus changed and determined depending on the print settings from the AC power supply 140. Particularly, the voltage waveform output from the AC power supply 140 is determined based on the AC_CLK signal, and the wave height (amplitude) of the output waveform is determined based on the duty ratio of the AC_PWM signal.

To use a piece of leather-like paper having low surface smoothness as the sheet, the present embodiment performs transfer by causing the toner to move (oscillate) in two ways (the transfer direction and the direction opposite thereto) with the superimposed voltage. This can increase the transfer ratio of the toner onto recessed portions and prevent an uneven density and the like, thereby improving the image quality. Furthermore, to use a piece of plain paper having high surface smoothness as the sheet, the present embodiment performs transfer by causing the toner to move in the transfer direction with the DC voltage. This can suppress scattering of the toner and prevent a blur and the like on an image, thereby improving the image quality.

In other words, according to the present embodiment, the image quality can be improved regardless of the print speed, the environment, and the surface smoothness of the sheet.

Alternatively, a low output DC power supply for a sheet having low surface smoothness and an AC power supply may be separated from an output path with a switching mechanism, such as a relay, and be connected only when used. This method, however, requires the low output DC power supply different from a DC power supply used to perform transfer onto a sheet having high surface smoothness, thereby increasing the mounting area and the cost.

By contrast, in the present embodiment, the DC power supply can be shared, thereby reducing the mounting area and the cost.

While the voltage is output from the AC power supply 140 as a square wave in the present embodiment, the voltage waveform is not limited thereto. The voltage may be output as a sinusoidal wave, for example.

Figure 14:
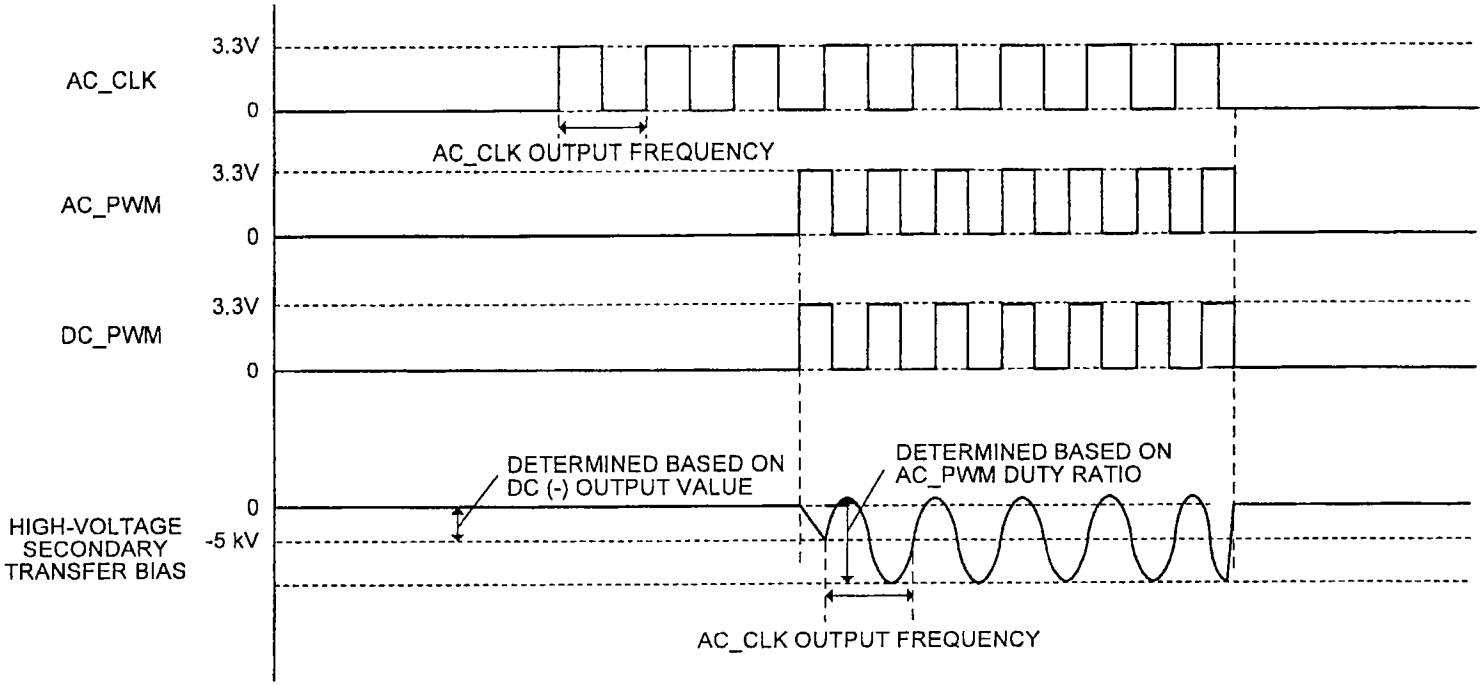
FIG. 14 is a view of an example in which a voltage is output from the AC power supply as a sinusoidal wave.

FIG. 14 is a view of an example in which the voltage is output from the AC power supply 140 as a sinusoidal wave. As illustrated in the example of FIG. 14, the amplitude of the voltage waveform of the sinusoidal wave output from the AC power supply 140 is determined based on the DC(−) output value and the AC(−) output value. The frequency of the voltage waveform of the sinusoidal wave output from the AC power supply 140 is determined based on the output frequency of the AC_CLK signal.

Figure 15:
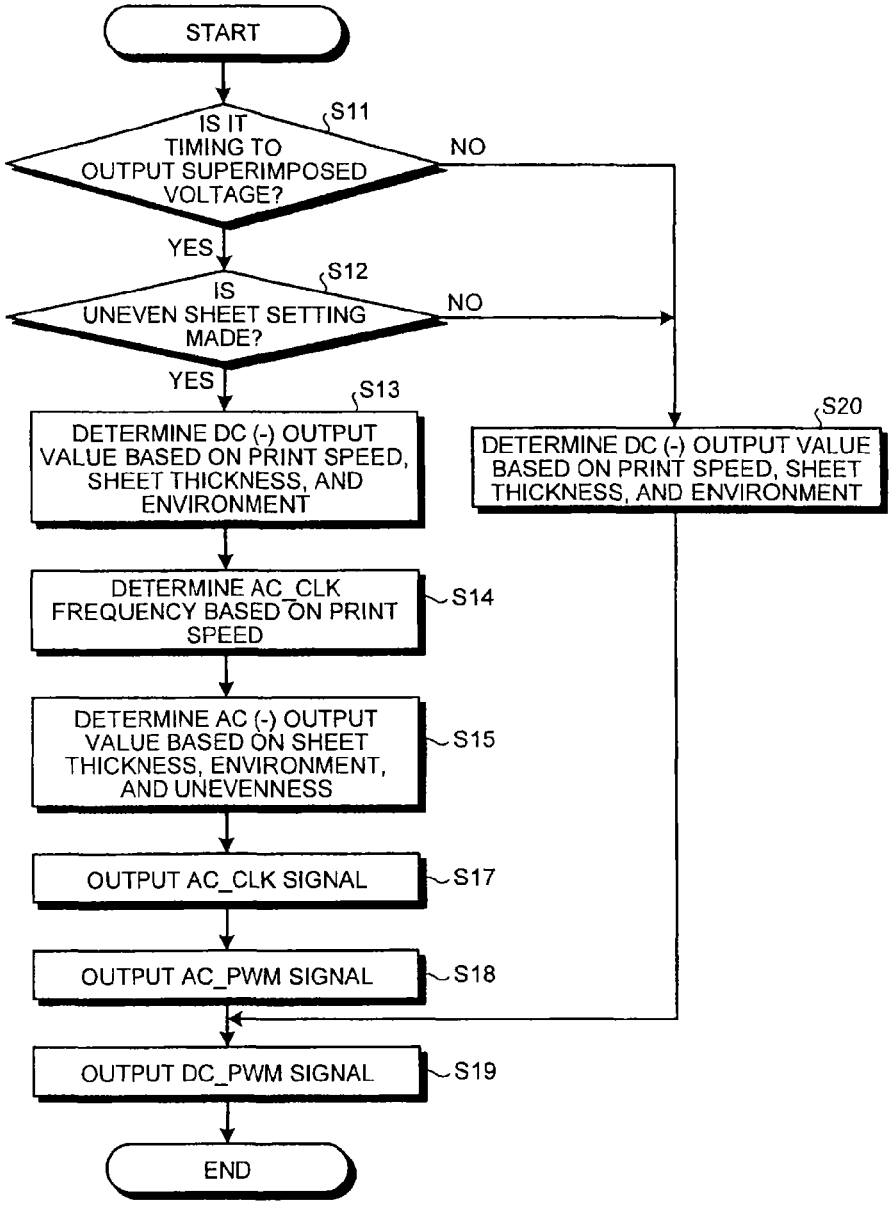
FIG. 15 is a flowchart of a process for outputting a voltage from the AC power supply as a sinusoidal wave.

FIG. 15 is a flowchart of a process for outputting a voltage from the AC power supply 140 as a sinusoidal wave. The processing of FIG. 15 is the same as that of FIG. 10 except that the processing for determining the AC_CLK duty ratio at Step S16 in FIG. 10 is not performed.

According to the present embodiment, it is possible to improve the voltage resistance property of the AC voltage transformer 143 such that the AC voltage transformer 143 can withstand application of the maximum output voltage of the AC power supply 140 and the maximum output voltage of the DC power supply 110. Specifically, the low-tension side (input side) of the secondary winding of the AC voltage transformer 143 is supplied with a high voltage. The present embodiment improves the voltage resistance property of the AC voltage transformer 143, thereby preventing a leakage of a current in the AC voltage transformer 143. The following describes this in detail.

Typically, a secondary winding of a step-up transformer is connected to the ground and a high-voltage output terminal. Thus, the low-tension side (input side) of the secondary winding is not supposed to be supplied with a high voltage. In the present embodiment, however, the secondary transfer power supply 100 outputs a superimposed voltage by inputting a DC high voltage generated by the DC power supply 110 to the low-tension side (input side) of the secondary winding N2_AC 156 of the AC voltage transformer 143 and superimposing an AC voltage thereon. This makes the voltage supplied to the low-tension side (input side) of the secondary winding higher than usual. As a result, a typical AC voltage transformer may possibly fail to achieve insulation of the secondary winding, thereby causing a leakage of a current in the AC voltage transformer.

To address this, in the present embodiment, the voltage resistance property of the AC voltage transformer 143 is enhanced such that the AC voltage transformer 143 can withstand application of the maximum output voltage of the secondary transfer power supply 100 (the maximum value of the superimposed voltage), that is, application of not only the maximum output voltage of the AC power supply 140 but also the maximum output voltage of the DC power supply 110 besides application of the maximum output voltage of the AC power supply 140.

Specifically, the pitch of the winding on the low-tension side (input side) of the secondary winding N2_AC 156 of the AC voltage transformer 143 is made larger than that of a typical AC voltage transformer. This enables the AC voltage transformer 143 to withstand the maximum output voltage of the secondary transfer power supply 100.

More specifically, because a step-up transformer is usually supplied with a higher voltage on the output side than the input side, the pitch of the winding is made larger on the output side. In the present embodiment, the pitch of the winding on the low-tension side (input side) of the secondary winding N2_AC 156 is large enough to withstand the maximum output voltage of the DC power supply 110. In addition, the pitch of the winding on the high-tension side (output side) of the secondary winding N2_AC 156 is large enough to withstand the maximum output voltage of the secondary transfer power supply 100 (the maximum value of the superimposed voltage).

In the present embodiment, a target value of the DC current in the case where the DC voltage alone is output (corresponding to the reference voltage in the current control circuit 122) is larger than a target value of the DC current in the case where the DC voltage is output with the AC voltage superimposed thereon by about several tens of percent. Similarly, the value of the DC voltage supplied when output of the DC current reaches the target value is larger in the case where the DC voltage alone is output than in the case where the DC voltage is output with the AC voltage superimposed thereon.

Thus, it seems that the maximum output voltage of the AC power supply 140 and the maximum output voltage of the DC power supply 110 are not applied simultaneously to the AC voltage transformer 143. The AC voltage transformer 143 does not seem to require the voltage resistance property high enough to withstand application of the maximum output voltage of the AC power supply 140 and the maximum output voltage of the DC power supply 110.

In the case where the DC voltage is output with the AC voltage superimposed thereon, however, the maximum output voltage of the AC power supply 140 and the maximum output voltage of the DC power supply 110 may possibly be applied simultaneously to the AC voltage transformer 143 temporarily depending on conditions, such as resistance on the sheet. To address this, in the present embodiment, the voltage resistance property of the AC voltage transformer 143 is enhanced such that the AC voltage transformer 143 can withstand application of the maximum output voltage of the AC power supply 140 and the maximum output voltage of the DC power supply 110.

In the present embodiment, voltage resistance property of peripheral circuits of the secondary winding N2_AC 156 is also enhanced such as the AC driving circuit 153, the primary winding N1_AC 154, and the primary winding N3_AC 155, besides the secondary winding N2_AC 156 of the AC voltage transformer 143.

Specifically, the peripheral circuits of the secondary winding N2_AC 156 are each arranged in a manner securing an insulation distance large enough to withstand application of the maximum output voltage of the secondary transfer power supply 100 to the secondary winding N2_AC 156 of the AC voltage transformer 143. In the present embodiment, the AC voltage transformer 143 is formed of the AC driving circuit 153, the primary winding N1_AC 154, the primary winding N3_AC 155, the secondary winding N2_AC 156, and the like. These circuits are each arranged in a manner securing an enough insulation distance in the AC voltage transformer 143. A practical insulation distance is determined depending on the maximum output voltage of the secondary transfer power supply 100, the structure and the material of the AC voltage transformer 143, the number of turns of the secondary winding N2_AC 156, and the thickness and the material of an insulator in the AC voltage transformer 143.

In the present embodiment, both of the DC voltage and the AC voltage are output via the AC voltage transformer 143. By using a winding having a thickness suitable for the maximum output voltage of the secondary transfer power supply 100, the present embodiment reduces the resistance value of the secondary winding N2_AC 156 and prevents generation of a large amount of heat.

The present invention can increase the transfer ratio of a developer onto recessed portions on a sheet surface and improve the image quality regardless of conditions for image formation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device comprising:

a power supply controller configured to control a first control signal and a second control signal, which is a pulse signal, based on a condition relating to image formation;

a DC power supply configured to output a DC voltage based on the first control signal;

an AC power supply configured to selectively output either of the DC voltage output from the DC power supply or a superimposed voltage obtained by oscillating the DC voltage output from the DC power supply with an amplitude determined based on a duty ratio of the second control signal; and a transfer unit configured to transfer a developer onto a sheet using a voltage output from the AC power supply, wherein:

the power supply controller further controls a third control signal based on the condition relating to image formation, and the AC power supply controls a frequency of the voltage output from the AC power supply based on a frequency of the third control signal.

2. The transfer device according to claim 1, wherein the AC power supply selectively outputs the superimposed voltage and the DC voltage with a waveform having an amplitude corresponding to an output value represented by the second control signal controlled by the power supply controller.

3. The transfer device according to claim 2, wherein the power supply controller controls the output value represented by the second control signal based on a thickness of the sheet, unevenness of the sheet, or environmental information serving as the condition relating to image formation.

4. The transfer device according to claim 1, wherein the power supply controller controls the frequency of the third control signal based on a print speed serving as the condition relating to image formation.

5. The transfer device according to claim 1, wherein the power supply controller receives the voltage output from the AC power supply and changes the duty ratio of the second control signal based on the voltage thus received.

6. The transfer device according to claim 1, wherein the DC power supply outputs the DC voltage depending on an output value represented by the first control signal changed by the power supply controller.

7. The transfer device according to claim 6, wherein the power supply controller controls the output value represented by the first control signal based on a print speed, a thickness of the sheet, or environmental information serving as the condition relating to image formation.

8. The transfer device according to claim 1, wherein the voltage output from the AC power supply has a square waveform.

9. The transfer device according to claim 1, wherein the voltage output from the AC power supply has a sinusoidal waveform.

10. An image forming apparatus comprising the transfer device according to claim 1.

11. A transfer device comprising:

a power supply controller configured to control a first control signal and a second control signal, which is a pulse signal, based on a condition relating to image formation;

a DC power supply configured to output a DC voltage based on the first control signal;

an AC power supply configured to selectively output either of the DC voltage output from the DC power supply or a superimposed voltage obtained by oscillating the DC voltage output from the DC power supply with an amplitude determined based on a duty ratio of the second control signal; and a transfer unit configured to transfer a developer onto a sheet using a voltage output from the AC power supply, wherein the DC power supply outputs the DC voltage depending on an output value represented by the first control signal changed by the power supply controller, and wherein the power supply controller receives the DC voltage output from the DC power supply and controls a duty ratio of the first control signal based on the DC voltage thus received.

12. The transfer device according to claim 11, wherein the AC power supply selectively outputs the superimposed voltage and the DC voltage with a waveform having an amplitude corresponding to an output value represented by the second control signal controlled by the power supply controller.

13. The transfer device according to claim 12, wherein the power supply controller controls the output value represented by the second control signal based on a thickness of the sheet, unevenness of the sheet, or environmental information serving as the condition relating to image formation.

14. The transfer device according to claim 11, wherein the power supply controller controls the frequency of the third control signal based on a print speed serving as the condition relating to image formation.

15. The transfer device according to claim 11, wherein the power supply controller receives the voltage output from the AC power supply and changes the duty ratio of the second control signal based on the voltage thus received.

16. The transfer device according to claim 11, wherein the voltage output from the AC power supply has a square waveform.

17. The transfer device according to claim 11, wherein the voltage output from the AC power supply has a sinusoidal waveform.

18. An image forming apparatus comprising the transfer device according to claim 11.

19. A power supply control method, comprising:

controlling a first control signal and a second control signal, which is a pulse signal, based on a condition relating to image formation;

outputting the DC voltage based on the first control signal;

selectively outputting either of the DC voltage output from the DC power supply or a superimposed voltage obtained by oscillating the DC voltage output from the DC power supply with an amplitude determined based on a duty ratio of the second control signal; and transferring a developer onto a sheet using a voltage that is output, wherein the method further comprises:

controlling a third control signal based on the condition relating to image formation; and controlling a frequency of a voltage output from an AC power supply using the third control signal.

* * * * *